US005328063A

United States Patent [19]

Beck et al.

[11] Patent Number: 5,328,063

[45] Date of Patent: Jul. 12, 1994

[54] VENTING CLOSURE CAP

[75] Inventors: James M. Beck, Carol Stream; Terry E. Kubitz, Cary, both of Ill.

[73] Assignee: Creative Packaging Corp., Buffalo Grove, Ill.

[21] Appl. No.: 74,917

[22] Filed: Jun. 10, 1993

[51] Int. Cl.[5] ..... B67D 5/06

[52] U.S. Cl. ..... 222/524; 222/525

[58] Field of Search ..... 222/188, 397, 481, 494, 222/521, 525, 524; 215/270, 271, 260, 307, 311, 315, 377; 220/367

[56] References Cited

U.S. PATENT DOCUMENTS

| | | | |
|---|---|---|---|
| 2,980,276 | 4/1961 | Robineau | 215/56 |
| 3,174,641 | 3/1965 | Kitterman | 215/56 |
| 3,201,013 | 8/1965 | Porter et al. | 222/525 |
| 3,216,603 | 11/1965 | Hannon, Jr. | 215/56 |
| 3,628,704 | 12/1971 | Corsette | 222/513 |
| 3,981,421 | 9/1976 | McDowell, Jr. et al. | 222/521 |
| 4,231,489 | 11/1980 | Malone | 215/307 |
| 4,253,588 | 3/1981 | Lester et al. | 222/153 |
| 4,506,809 | 3/1985 | Corsette | 222/525 |
| 4,625,899 | 12/1986 | Stull | 222/521 |
| 4,646,947 | 3/1987 | Stull | 222/397 |
| 4,664,288 | 5/1987 | Pereira et al. | 220/209 |
| 4,685,580 | 8/1987 | Towns et al. | 215/260 |
| 4,773,572 | 9/1988 | Stull | 222/525 |
| 4,785,978 | 11/1988 | Kano et al. | 215/315 |
| 4,799,598 | 1/1989 | McFadyen | 215/260 |
| 4,817,831 | 4/1989 | Theisen | 222/499 |
| 4,826,055 | 5/1989 | Stull | 222/524 |
| 4,828,129 | 5/1989 | Jonkers | 215/260 |
| 4,927,065 | 5/1990 | Beck | 222/525 |
| 4,967,941 | 11/1990 | Beck | 222/521 |
| 5,072,863 | 12/1991 | Stull | 222/523 |

OTHER PUBLICATIONS

Inopak Ltd., Ultra Flo dispenser combined with the new "Squeeze-Me" container. Undated 2 page brochure. (No date).

*Primary Examiner*—Andres Kashnikow
*Assistant Examiner*—Philippe Derakshani
*Attorney, Agent, or Firm*—Silverman, Cass & Singer, Ltd.

[57] ABSTRACT

A closure cap which can be manipulated to dispense container contents end enables venting of any excess pressure which may build up within the container when the closure is in a fully closed position including a central post, a cap body reciprocally mounted on and about the periphery of the post and having an aperture including an inner periphery which cooperates with the post to form a variable opening therebetween including a fully closed position and a plurality of dispensing positions for dispensing the contents of the container at a plurality of different rates and a venting mechanism for enabling any excess pressure from within the container to exhaust through the cap to the exterior of the container upon reaching a predetermined pressure within the container when the cap is positioned in the fully closed position.

11 Claims, 1 Drawing Sheet

FIG. 1
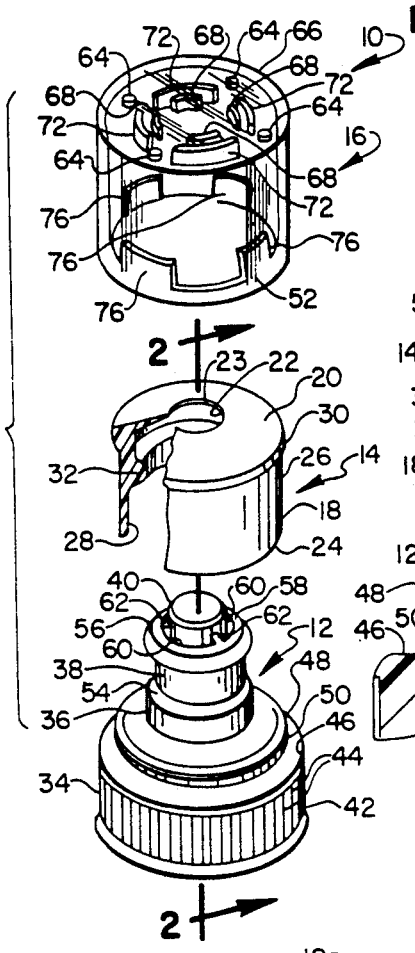
FIG. 2
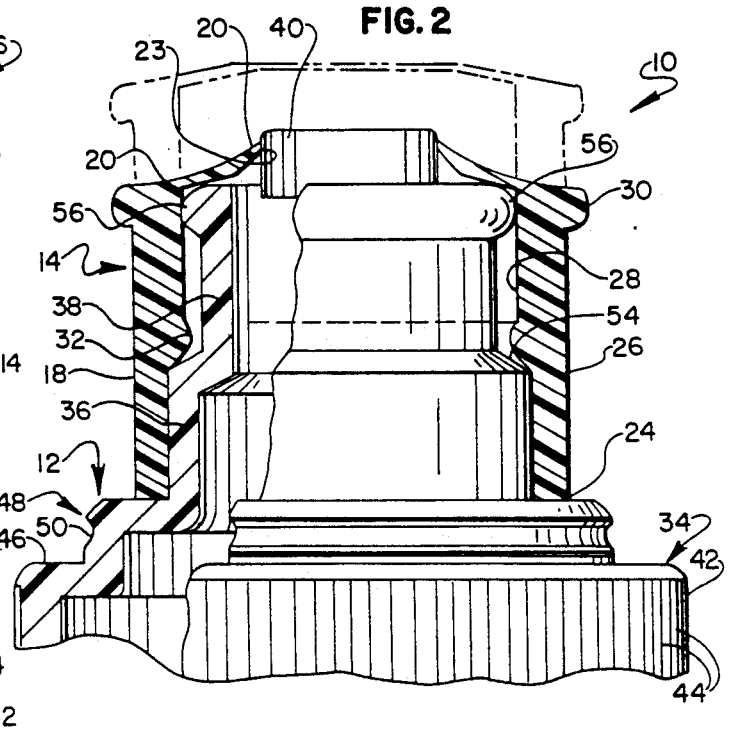
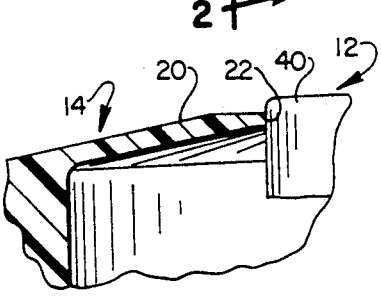
FIG. 3
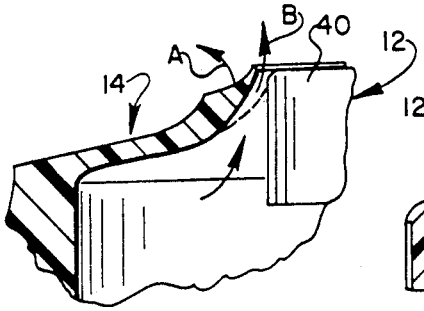
FIG. 4
FIG. 5
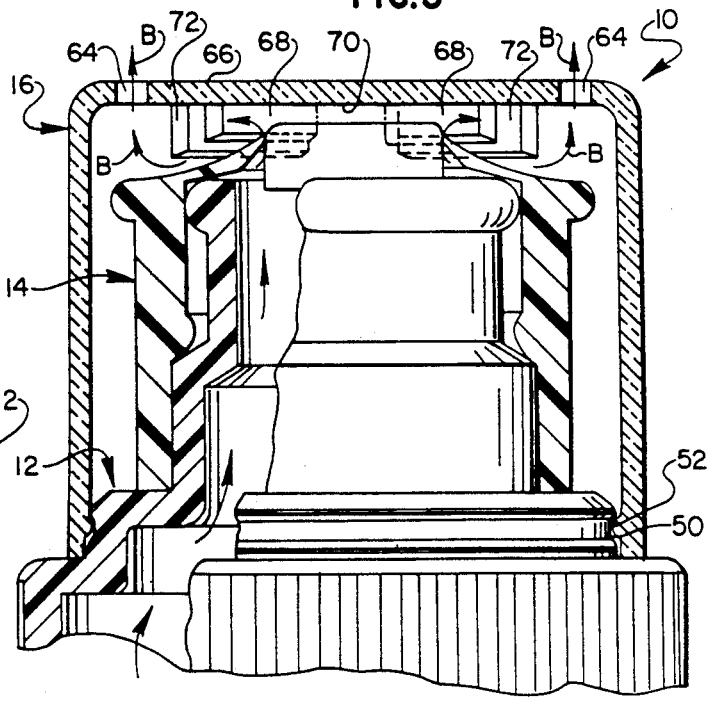

VENTING CLOSURE CAP

BACKGROUND OF THE INVENTION

1. Field of the Invention

This invention relates generally to dispensing closure caps for containers, and more particularly to an adjustable dispensing closure cap having more than one dispensing position which provides venting of any excess pressure which may build up within the container when the closure is in a fully closed position.

2. Description of the Related Art

Dispensing closure caps for containers typically are of the push-pull or threaded screw type and include a fully open dispensing position, a fully closed position and one or more intermediate dispensing positions. An example of such a closure is illustrated in U.S. Pat. No. 4,967,941 which is assigned to the same assignee as the assignee herein. That patent discloses a variable dispensing closure which provides positive indication of the cap position during manipulation.

During shipping, handling, storage and use of the container, excess pressure can build up within the container when the closure is in a fully closed position. Such pressure build up typically is dependent on the material within the container and the conditions which the container is subjected to during storage and handling. If excess pressure is allowed to accumulate, the container may rupture or distort, the cap may be dislodged from the container or the contents may explode outward upon initial opening of the cap.

Additionally, it frequently is desirable to heat container contents within the container prior to use, such as cheese sauce products or ice cream topping, for example. Heating typically is accomplished with a microwave oven, boiling water or any similar method. Heating can cause excess pressure to develop and build up within the container which must be vented for the reasons given above.

Existing closures which provide venting typically are utilized with squeeze bottles. These bottles are opened to dispense container contents by squeezing the bottle to increase the pressure within the bottle and open a discharge valve. When released, the bottle expands to close the discharge valve and simultaneously open a separate vent valve to admit outside air into the bottle to replenish the amount of product dispensed.

An example of such a closure and squeeze bottle is illustrated in U.S. Pat. No. 4,506,809 which discloses a combined product discharge and air vent passage controlled by a diaphragm valve. Such a closure, however, does not provide for venting of any excess interior pressure when the closure is in the fully closed position. Additionally, such a closure is very complex in design, is difficult and expensive to manufacture, particularly in a molding process, and can be too fragile to be used repeatedly without failure.

It therefore is desirable to provide a variable dispensing closure cap which provides venting of pressure from within a container in a fully closed position, is simple in design, can readily be molded with a minimum number of parts and is sturdy in construction for repeated use without failure.

SUMMARY OF THE INVENTION

The invention provides a closure cap which can be manipulated to dispense container contents and enables venting of any excess pressure which may build up within the container when the closure is in a fully closed position. The cap includes a central post having a top surface and a substantially cylindrical imperforate peripheral wall with an opening to the top surface for metering the contents to be dispensed and a cap body reciprocally mounted on and about the periphery of the post. The cap body includes an aperture having an inner periphery which cooperates with the post peripheral wall to form a variable opening between the cap body inner periphery and the post peripheral wall to provide a fully closed position and a plurality of dispensing positions for dispensing the contents of the container at a plurality of different rates as the cap body is moved on the post away from the closed position. The cap also includes a venting mechanism for enabling any excess pressure from within the container to exhaust through the cap to the exterior of the container upon reaching a predetermined pressure within the container when the cap is positioned in the fully closed position.

For protection of the cap and to prevent opening of the cap during shipping and handling, an overcap also may be provided which does not inhibit operation of the venting mechanism.

BRIEF DESCRIPTION OF THE DRAWING

FIG. 1 is an exploded perspective view of the venting closure cap of the invention illustrating a central post, a body portion and an overcap;

FIG. 2 is an enlarged cross-sectional view of the closure cap of the invention taken along line 2—2 of FIG. 1 and in the direction indicated generally without the overcap and illustrating the central post in partial section, the fully closed position of the cap in solid lines and the fully open position of the cap in dotted lines;

FIG. 3 is an enlarged cross-sectional view of a portion of the central post and body portion of the invention in a fully closed, unvented position;

FIG. 4 is an enlarged cross-sectional view, similar to FIG. 3, illustrating a flexed venting position of the body portion about the central post; and FIG. 5 is an enlarged cross-sectional view of the closure cap of the invention, similar to FIG. 2, illustrating venting of the closure with the overcap in place.

DESCRIPTION OF THE PREFERRED EMBODIMENTS

Referring to FIG. 1, the venting dispensing closure cap of the invention is designated generally by the reference numeral 10. The cap 10 preferably includes an inner metering post or stem 12, an outer cap body 14 and an overcap 16.

Briefly, in operation, as FIG. 2 illustrates, the body 14 moves along a portion of the length of the post 12 from a fully closed position, illustrated in solid lines, through a plurality of intermediate dispensing positions to a fully open position, illustrated in dotted lines. As FIG. 4 illustrates, when the cap 10 is in the fully closed position, illustrated in dotted lines, the body 14 can flex upward substantially in the direction of arrow "A" away from the post 12 to the vented position illustrated in solid lines. In this vented position, excess pressure from within a container (not illustrated) can vent to ambient atmosphere about the periphery of the post 12 substantially along line "B".

Preferably, the body 14 is mounted to the post 12 for a push-pull type operation as explained in detail hereinafter. The body 14, however, can be mounted to the post 12 for a rotational screw or twist lock type operation or a combination of push-pull and screw operation without departing from the teachings of the present invention.

As FIGS. 1 and 2 illustrate, the body 14 includes a bottom skirt 18 and a top outwardly inclined, tapered annular surface 20 having a central aperture 22 therethrough. Thus, the top surface 20 substantially is conical in cross-sectional configuration tapering to the central aperture 22 and is relatively thin and flexible about the aperture 22 to provide the desired seal and venting as described hereinafter.

The aperture 22 has an inner periphery 23 which mates with the post 12 and provides a seal therebetween when the cap 10 is in the fully closed position to prevent the contents of the container from passing through the cap 10. The skirt 18 includes a bottom edge 24, an outer cylindrical side wall 26 and an inner cylindrical side wall 28.

As the body 14 is moved upwardly along the post 12, the top surface 20, aperture 22 and inner periphery 23 disengage from the top of the post 12 to allow the contents of the container to pass through the aperture 36 and out of the cap 10. It is to be noted that the further the body 14 moves upwardly along the post 12, the greater the distance between the inner periphery 23 and the post 12 and the greater the flow rate through the cap 10.

To enable manipulation of the body 14 along the post 12, a shoulder 30 can be formed on the outside of the body 14 between the top surface 20 and the outer side wall 26. To mount the body 14 to the post 12, as described in detail below, the inner side wall 28 of the body 14 includes an annular rib 32.

The post 12 includes a bottom skirt 34 as well as first, second and third substantially cylindrical imperforate peripheral wall portions 36, 38 and 40. The second wall portion 38 preferably has an outer diameter slightly less then the outer diameter of the first wall portion 36. Similarly, the third wall portion 40 preferably has an outer diameter slightly less than the outer diameter of the second wall portion 38. Thus, the outer diameter of the post 12 becomes progressively smaller as the post 12 extends from the bottom skirt 34 to the third wall portion 40 which mates with the inner periphery 23 of the body 14.

The bottom skirt 34 typically is threadedly secured to a container neck (not illustrated). In order to assist in securing the post 12 to and from the container, an outside wall 42 of the bottom skirt 34 can be knurled by providing a plurality of outstanding ribs 44. The particular design of the bottom skirt 34, as well as the connection of the bottom skirt 34 to a container, can vary.

To seat the overcap 16 to the post 12, a first annular shoulder 46 integrally is formed with the post 12 proximate the bottom skirt 34. A fourth cylindrical imperforate wall portion 48 is formed on the post 12 between the first shoulder 46 and the first wall portion 36 and includes an annular recess 50 formed about its outer periphery.

As FIG. 5 illustrates, to snappingly engage the overcap 16 to the post 12, the overcap 16 includes an internal annular rib 52. The rib 52 seats within the recess 50 of the post 12 when the overcap 16 is assembled to the post 12. If desired, a tamper-indicating strap or tape (not illustrated) can be utilized.

As FIG. 1 illustrates, to provide for engagement of the body 14 to the post 12, a second annular shoulder 54 is formed on the post 12 between the first and second wall portions 36 and 38 and an annular rib 56 is formed proximate the top end of the second wall portion 38. When the body 14 is mounted to the post 12, the rib 32 of the body 14 is forced over the rib 56 of the post 12 and is seated between the rib 56 and the second shoulder 54. Thus, the rib 32 seats against the shoulder 54 when in the fully closed position of the cap 10, rides along the second wall portion 38 to provide intermediate dispensing positions and seats against the rib 56 when the cap 10 is in the fully open position.

To enable the container contents to flow through the post 12, a shoulder 58 between the second and third wall portions 38 and 40 can include a plurality of slotted apertures 60 separated by a plurality of ribs 62. Thus, when the cap 10 is in one of its open positions, the contents can flow from the container, through the post 12, the apertures 60 and the aperture 22 of the body 14.

As FIGS. 2 and 3 illustrate, when in the fully closed position of the cap 10, the inner surface 23 of the aperture 22 of the body 14 seals against the third wall portion 40 of the post 12 to prevent any of the container contents from escaping. As FIG. 4 illustrates, upon build up of sufficient pressure within the container, the top surface 20 can flex upwardly substantially in the direction of arrow "A" to break the seal with the third wall portion 40 and enable the excess pressure to escape substantially along line "B".

It is to be noted that the cap 10 can be provided to vent at different pressures by adjusting the material, configuration or both of either the post 12 or body 14. Additionally, one or more strengthening ribs or relieved portions (not illustrated) can be provided to the upper surface 20 to change its flexibility and likewise adjust the venting pressure.

As FIGS. 1 and 5 illustrate, to provide for venting when the overcap 16 is attached to the post 12, such as during shipping and storage, the overcap 16 includes a plurality of apertures 64 which extend through a top 66 of the overcap 16. Thus, pressure escaping along the line "B" continues through the apertures 64 when the overcap 16 is mounted to the post 12.

To restrict flexing and venting of the top surface 20 of the body 14 when the overcap 16 is applied, the overcap 16 also includes a first set of four semi-circular shaped flanges 68 depending from a top inside surface 70 and arranged in a circle. These flanges 68 prevent container contents from being expelled during shipping and storage yet enable enough flexing of the top surface 20 to provide venting.

To prevent the body 14 from moving to its open position during shipping and storage, the overcap 16 also includes a second set of four semi-circular shaped flanges 72 depending from the top inside surface 70 of the overcap 16 which are arranged in a circle and circumscribe the first set of four flanges 68. The flanges 72 are slightly longer and taller than the flanges 68 and engage the top surface 20 of the body 14 to prevent any excess upward movement of the body 14 which could open the cap 10 during shipping and handling.

As FIG. 1 illustrates, the overcap 16 also includes four rectangular indentations or relieved areas 76 positioned about the bottom of the overcap 16. The relieved areas 76 enable any liquid which may enter the overcap 16 to escape out of the bottom thereof. For example, after the container is filled and the cap 10 is installed, it sometimes is desirable to wash any excess contents from about the cap 10 and container. If any water enters the apertures 64 in the overlap 16, the water can vent through the relieved areas 76.

In operation, to open the cap 10, the body 14 merely is pulled upward with respect to FIG. 2 to either the fully open position or an intermediate dispensing position. If the contents are to be heated, such as in a microwave oven, the body 14 preferably is positioned in the fully open position to enable venting. If a user neglects to open the cap 10, however, the top surface 20 will flex as described herein to enable venting to occur if necessary.

Similarly, if pressure builds up within the container during shipping or storage, or a user neglects to remove the overcap 16 before heating, venting of the cap 10 still will occur through the apertures 64 of the overcap 16. Furthermore, the flanges 68 and 70 of the overcap 16 prevent any excess venting or movement of the body 14 to an open position.

Modifications and variations of the present invention are possible in light of the above teachings. A specific dimension, material or construction is not required so long as the assembled device functions as described herein. It therefore is to be understood that within the scope of the appended claims, the invention may be practiced otherwise than as specifically described.

What is claimed and desired to be secured by letters patent is:

1. A closure cap which can be manipulated to dispense container contents and enables venting of any excess pressure which may build up within the container when the closure is in a fully closed position, comprising:

a central post having a top surface and a substantially cylindrical imperforate peripheral wall with an opening to said top surface for metering the contents to be dispensed;

a cap body reciprocally mounted on and about the periphery of said post and having an aperture formed in a top surface of said body and including an inner periphery which cooperates with said post peripheral wall to form a variable opening between said cap body inner periphery and said post peripheral wall to provide a fully closed position and a plurality of dispensing positions for dispensing the contents of said container at a plurality of different rates as said cap body is moved on said post away from said closed position; and venting means for enabling any excess pressure from within the container to exhaust through said cap to the exterior of the container upon reaching a predetermined pressure within the container, said pressure being vented between said top surface of said peripheral wall and said inner periphery of said cap body by flexing of said top surface to disengage said inner periphery from said post peripheral wall when the cap is positioned in said fully closed position.

2. The cap as defined in claim 1 wherein said top surface of said body is conical in cross-sectional configuration tapering to the aperture and is relatively thin and flexible about the aperture.

3. The cap as defined in claim 1 including protective overcap means installed over said cap body for providing protection to said cap when affixed thereto and for enabling venting of said excess pressure from said venting means.

4. The cap as defined in claim 3 wherein said overcap means prevent opening of said cap body to any of said dispensing positions.

5. The cap as defined in claim 4 wherein said overcap means include a first set of depending flanges which abut a top surface of said cap body having said aperture therein to prevent opening of said cap body to any of said dispensing positions.

6. The cap as defined in claim 3 wherein said overcap means restrict venting of said venting means to a predetermined amount.

7. The cap as defined in claim 6 wherein said overcap means include a second set of depending flanges which abut a top surface of said cap body having said aperture therein to restrict venting of said venting means.

8. A closure cap which can be manipulated to dispense container contents and enables venting of any excess pressure which may build up within the container when the closure is in a fully closed position, comprising:

a central upstanding post having a first substantially cylindrical imperforate peripheral wall portion, a second reduced diameter substantially cylindrical imperforate peripheral wall portion positioned on top of said first wall portion and having a top surface, and a peripheral shoulder portion connecting said first and second wall portions together, said shoulder portion including at least one opening to said post top surface for metering the contents to be dispensed;

a cap body reciprocally mounted on and about the periphery of said central post and having an aperture whose inner periphery cooperates with said peripheral wall of said second wall portion to provide a closed position and a plurality of dispensing positions for dispensing the contents at a plurality of different rates as said cap body is moved on said post away from said closed position; and venting means for enabling any excess pressure from within the container to exhaust between said top surface of said peripheral wall and said inner periphery of said cap body to the exterior of the container upon reaching a predetermined pressure within the container when the cap is positioned in said fully closed position.

9. The cap as defined in claim 8 including protective overcap means installed over said cap body for providing protection to said cap when affixed thereto and for enabling venting of said excess pressure from said venting means.

10. The cap as defined in claim 9 wherein said overcap means prevent opening of said cap body to any of said dispensing positions.

11. The cap as defined in claim 9 wherein said overcap means restrict venting of said venting means to a predetermined amount.

* * * * *

UNITED STATES PATENT AND TRADEMARK OFFICE

CERTIFICATE OF CORRECTION

PATENT NO. : 5,328,063

DATED : July 12, 1994

INVENTOR(S) : James M. Beck and Terry E. Kubitz

It is certified that error appears in the above-indentified patent and that said Letters Patent is hereby corrected as shown below:

Abstract, line 2, "end" should be --and--.

Signed and Sealed this

Thirteenth Day of September, 1994

*Attest:*

*Attesting Officer*

BRUCE LEHMAN

*Commissioner of Patents and Trademarks*